United States Patent [19]

Mendelson

[11] Patent Number: 4,711,677

[45] Date of Patent: Dec. 8, 1987

[54] HIGH TEMPERATURE BUSHING ALLOY

[75] Inventor: Ralph A. Mendelson, Anaheim, Calif.

[73] Assignee: The Garrett Corporation, Los Angeles, Calif.

[21] Appl. No.: 888,188

[22] Filed: Jul. 18, 1986

[51] Int. Cl.[4] ..... C22C 38/48

[52] U.S. Cl. ..... 148/325; 148/336; 420/12; 420/42; 420/65; 420/69

[58] Field of Search ..... 148/325, 336, 136; 420/12, 42, 65, 69

[56] References Cited

U.S. PATENT DOCUMENTS 3,969,109 7/1976 Tanczyn ..... 148/325

4,486,321 12/1984 Fujiwara et al. ..... 252/46.3

OTHER PUBLICATIONS

Handbook of Stainless Steel-David Peckner & I. M. Bernstein, copyright 1977, McGraw-Hill Inc., pp. 10-2 to 10-18.

*Primary Examiner*—L. Dewayne Rutledge

*Assistant Examiner*—George Wyszomierski

*Attorney, Agent, or Firm*—J. Henry Muetterties; James W. McFarland; R. Steven Linne

[57] ABSTRACT

A cast austenitic stainless steel bushing for relatively high temperature turbocharger and automotive applications is provided having good hot hardness and hot strength properties and a co-effficient of thermal expansion approximating that of the parent housing alloy. Bushings made of this alloy have a composition in the range of 29-32% chromium; 4-8% nickel, 1.0-1.5% columbium and tantalum; 1.3-1.7% carbon, 0.25-0.45% sulfur, 0.3-0.4% nitrogen, up to 1.0% manganese, up to 1.0% silicon, up to 1.0% molybdenum, up to 0.1% phosphorous, balance iron.

14 Claims, No Drawings

HIGH TEMPERATURE BUSHING ALLOY

FIELD OF THE INVENTION

This invention relates to cast stainless steel bushing material used in motive parts subjected to relatively high service temperatures, e.g. bushings for turbocharger wastegate valves, engine valve guides, where hot hardness/strength and a relatively high co-efficient of thermal expansion are required.

BACKGROUND OF THE INVENTION

The alloys used for bearing or bushing surfaces are of necessity different from the alloys used for the engine or motor housing. This is particularly true in turbocharger and superchargers where hot gases and high rotating speeds are encountered. Cast bushings to which my present invention is applicable, for example, bushing for automotive or aircraft turbocharger housings, are subject to elevated operating temperatures up to about 2000° F., and corrosive hot exhaust gases. In turbochargers for truck diesel engines, the temperature reaches 1300°-1400° F., resulting in housing metal temperatures of 1200°-1300° F. In passenger car turbochargers, however, the operating temperatures extend up to the 1750°-2000° F. range, which results in metal temperatures of 1550°-1950° F.

Bushing materials used in turbocharger housings and similar applications for valves such as the wastegate valve of a turbocharger must be of an alloy which has a relatively high co-efficient thermal expansion and sufficient strength and oxidation resistance to function at the relatively high temperatures encountered in turbocharger and engine applications. It has been found that many of the bushing materials currently used which have sufficient strength and oxidation resistance at turbocharger operating temperatures, tend to have a co-efficient of thermal expansion which is so different from the parent housing material that the temperature cycling frequently causes dislocation of the bushing which results in either an improper function of the valve or a failure due to the displacement of the bushing. Consequently, some of the bushings used for turbocharger applications frequently fail after 100-200 hours of operation.

The prior art bushing materials are of two types—the first is a cast stainless steel ferritic matrix alloy which is selected because of its excellent oxidation resistance and hot hardness. However, the low thermal expansion coefficient of such material has resulted in a relatively low life span for such bushings. The material has a co-efficient of thermal expansion of about $11\times10^{-6}$ cm/cm/°C. The cast stainless steel turbocharger housing material disclosed in my co-pending application U.S. Ser. No. 749,153, has a co-efficient of thermal expansion of about 18.6 cm/cm/°C. Other housing materials such as Ni-Resist (Trademark of International Nickel Co) has a similar coefficient of expansion at temperature. Hence with this significant difference in the co-efficient of expansion of the bushing and the parent housing alloy, it is apparent that under repeated heating and cooling, the bushing would become loose and possibly fall out or become disclocated so that the wastegate valves, for which the bushing is provided, would not function properly. A second type of bushing material commonly used, is a composite bushing material made by powder metallurgical techniques. This composite material is comprised of 10-20% of a material which is a Laves phase cobalt alloy having a moderately oxidation resistant stainless steel filler which has a higher co-efficient of expansion. It has been found with such expensive composite materials that oxidation eventually results in spalling of the material thereby preventing valve movement within the bushing. The stainless filler material has a relatively high co-efficient thermal expansion. The stainless steel by itself has a a low oxidation rate and poor bushing or bearing properties. Since the material is porous it has a large internal surface area which when exposed to an oxidation environment will oxidize and spall, thus subjecting the bushing to frequent mechanical failures after a relatively short usage.

It is therefore an object of my present invention to provide a bushing material having good oxidation resistance and hardness at turbocharger operating temperatures of up to 1800°-2000° F. which also has a relatively high co-efficient of thermal expansion approximating the thermal expansion of the parent housing material.

Other objects and a more complete understanding of my invention will be apparent from the following specification and claims.

SUMMARY OF THE INVENTION

In accordance with my present invention, a cast non-ferritic stainless steel, preferably austenitic stainless steel, is used as a bushing material in applications subject to high operating temperatures and mild oxidizing atmosphere such as an automobile turbocharger bushing for a wastegate valve or for valve guides or any other high temperature bushing applications where hot hardness and strength is a requirement. The alloy of my present invention, having a composition in the range of 29-32% chromium; 4-8% nickel, 1.0-1.5% columbium or tantalum; 1.3-1.7% carbon, 0.25-0.45% sulfur, 0.3-0.4% nitrogen, up to 1.0% manganese, up to 2.0% silicon, up to 1.0% molybdenum, up to 0.1% phosphorous, balance iron and has a cast carbidic structure within a matrix of austenite. The alloy also has the unique property of having a high co-efficient of thermal expansion which is particularly important in applications where the bushing material contacts a base or housing metal of another composition which has a relatively high co-effcient of thermal expansion. My present alloy, having a high coefficient of thermal expansion, will expand at approximately the same rate as the base housing material and thus maintain the dimensional tolerance between the bushing and the base metal as the temperature of the turbocharger increases or decreases.

In accordance with my present invention, it has been found that an austenitic stainless steel material having a carbidic structure within a austenitic matrix in a low nickel stainless steel has a satisfactorily increased co-efficient of thermal expansion with the oxidation resistance and hardness at elevated temperatures to satisfy all the criteria for a turbocharger bushing.

DESCRIPTION OF THE PREFERRED EMBODIMENT

The preferred steel casting alloy composition for relatively high temperature bushing applications in a turbocharger housing subject to corrosive conditions, in accordance with my present invention, is a cast austenitic stainless steel having a carbidic structure within a matrix of austenite. The preferred chemistry of my alloy is as follows: 29-32% chromium, 4-8% nickel, 1.0-1.5% columbium or tantalum, 1.3-1.7% carbon, 0.25–0.45% sulfur, 0.3–0.4% nitrogen, up to 1.0% manganese, up to 2.0% silicon, up to 1.0% molybdenum, up to 0.1% phosphorous, balance iron. An alloy having a composition in the range given above is cast and heat treated up to 1200° C. for up to 5 hours. Thereafter the alloy is cooled to room temperature either by furnace or air cooling.

Carbon is added to provide the carbidic structure within the matrix of austenite and it is believed that at least 1.3% Carbon is desirable in order to provide the desired hardness. The upper limit of Carbon is controlled by excessive carbide formation. Too much carbon will result in brittleness.

Manganese is added to stabilize the austenite and the amount to be added is believed to be maximum of 1.0%.

Sulfur is added to the present alloy to enhance machineability. Too much sulfur results in brittle and/or low melting sulfides which would cause the alloy to be useless.

Silicon is added to the alloy to improve its castability and to combine in the formation of the complex $M_{23}C_6$ carbides in an amount up to 2%. Less than 1% silicon would be ineffective and more than 2% would cause extreme brittleness.

Chromium is important in my present alloy to provide both oxidation resistance and to form the $M_{23}C_6$ and more complex carbides.

Nickel is effective in increasing the strength of my present alloy and provides the austenitic matrix. The amount of nickel is carefully controlled in my present alloy and balanced with increased nitrogen to give the same effect as nickel in the production of austenite. Hence, at least 0.3% nitrogen is important in my present alloy to reduce the nickel requirement.

Columbium or tantalum may be added to my present alloy in the total amount of 1.0–1.5% and are added for strengthening since they both produce very stable (MC) carbides.

Molybdenum is desirable in my present alloy to combine with the sulfur and to enhance machineability and also it increases the high temperature strength by the formation of a carbide in the presence of silicon. Up to 1% molybdenum is acceptable, and more than 1% would increase the cost without much additional benefit.

EXAMPLE I

A turbocharger housing was cast of the material disclosed in the aforementioned co-pending application U.S. Ser. No. 749,153 and the wastegate valve bushings for such turbocharger were made of the alloy of my present invention having the following composition: 29–32% chromium, 4–8% nickel, 1.0–1.5% columbium and tantalum, 1.3–1.6% carbon, 0.25–0.45% sulfur. 0.3–0.4% nitrogen, up to 1.0% manganese, up to 2.0% silicon, up to 1.0% molybdenum, up to 0.1% phosphorous, balance iron. The co-efficient of thermal expansion of this bushing alloy was determined to be $19.6\times10^{-6}$ cm/cm/°C. The co-efficient of thermal expansion of the base housing material was determined to be $18.6\times10^{-6}$ cm/cm/°C. The co-efficient of expansion of the prior art cast ferritic matrix bushing alloy discussed above is about $11\times10^{-6}$ cm/cm/°C. and the co-efficient of thermal expansion of Triaboly is $11.2\times10^{-6}$ cm/cm/°C., hence a co-efficient of expansion of over about $15\times10^{6}$ is required for desirable bushing alloy in accordance with my present invention.

The turbocharger described above with the housing alloy described in the aforementioned patent application assigned U.S. Ser. No. 749,153 was provided with a wastegate valve bushing of the alloy of my present invention and the turbocharger has been operated for over 400 hours without failure.

EXAMPLE II

According to the present invention, the alloy having a composition of 1.66% carbon, 1.96% Silicon, 30.8% chromium, 4.7% nickel, 0.70% manganese, 0.04% phosphorous, 0.28% sulfur, 0.78% molybdenum, nitrogen content not measured, but added in the range of 0.4%, balance iron; was cast in blanks. As cast, the alloy had a hardness of 29–33 HRC. Thereafter, the material was subjected to a heat treatment of 950° C. for 5 hours and air cooled. After this heat treatment the alloy had a hardness of 44–46 HRC. Other blanks were heat treated to 950° C. for 2 hours and furnace cooled. After this heat treatment the hardness was 36–46 HRC.

Blanks of the alloy in the air cast condition were determined to possess the following characteristics; carbides 916–1353 HV 0.010; matrix 292–351 HV 0.025 and non-metallic inclusion 302–313 HV 0.025. Furthermore, the non-metallic inclusions contained the elements of iron, chromium, manganese and sulfur.

Although my present invention has been described herein with a certain degree of particularity in reference to certain specific alloy compositions which were formulated and tested, it is to be understood that the scope of my invention is not to be so limited, but should be afforded the full scope of the appended claims.

I claim:

1. A cast austentic stainless steel bushing having a good oxidation resistance and strength at operating temperatures up to 2000° F. and a coefficient of thermal expansion of at least $15\times10^{-6}$ cm/cm/°C. and consisting essentially of about 29–32% chromium, 4–8% nickel, 1.3–1.7% carbon, 0.25–0.45% sulfur, 0.3–0.4% nitrogen, up to 1.0% manganese, up to 2.0% silicon, up to 1.0% molybdenum, up to 0.1% phosphorous, balance iron.

2. The bushing of claim 1 wherein said bushing is a non-ferritic material.

3. The bushing of claim 1 wherein said bushing has a cast carbidic microstructure within an austenitic matrix.

4. The bushing of claim 1 having a room temperature hardness of about 30–70 Rockwell C.

5. The bushing of claim 1 having a coefficient of expansion of approximately $19.6\times10^{-6}$ cm/cm/°C.

6. The bushing of claim 1 having a composition consisting essentially of about: 30.8% chromium, 4.7% nickel, 1.66% carbon 0.28% sulfur, 0.70% manganese, 1.96% silicon, 0.78% molybdenum, 0.04% phosphorous, 0.3–0.4% nitrogen, and the balance iron plus incidental impurities.

7. The bushing of claim 1 further including about 1.0 to 1.5% of a carbide forming element selected from the group consisting of columbium, tantalum, and mixtures thereof.

8. The bushing of claim 1 made by the process of heat treating the cast bushing at 1650°–2200° F. for up to 5 hours and thereafter cooling the bushing.

9. The bushing of claim 8 subjected to said heat treatment at about 2200° F. for about one hour.

10. The bushing of claim 8 wherein said heat treatment was at 1740° F. for 2 hours and then furnace cooled.

11. The bushing of claim 8 made by the process of heat treating at 1740° F. for 5 hours and thereafter air cooling.

12. The bushing of claim 11 having a room temperature hardness of 43–46 Rockwell C.

13. A cast austentic stainless steel bushing having a good oxidation resistance and strength at operating temperatures up to 2000° F. and a coefficient of thermal expansion of at least $15\times10^{-6}$ cm/cm/°C. and consisting essentially of 30.8% chromium, 4.7% nickel, 1.0–1.5% columbium or tantalum, 1.66% carbon, 0.18% sulfur, 0.3–0.4% nitrogen, 0.70% manganese, 1.96% silicon, 0.78% molybdenum, 0.04 phosphorous and the balance iron.

14. An improved iron base alloy of the type suitable for use as a bushing at operating temperatures of up to about 2000° F., wherein the improvement comprises a composition, in weight percent, consisting essentially of about: 29 to 32% chromium, 4 to 8% nickel, at least 0.3% nitrogen, at least 1.3% carbon, up to 0.45% sulfur, up to 1% manganese, up to 1% molybdenum, up to 2% silicon, and up to 1.5% of a carbide former selected from the group consisting of columbium and tantalum, the balance iron plus usual impurities.

* * * * *